US006913188B2

(12) United States Patent
Wong et al.

(10) Patent No.: US 6,913,188 B2
(45) Date of Patent: Jul. 5, 2005

(54) SLEEVE WITH CORNER TABS

(75) Inventors: Galen C. Wong, South Pasadena, CA (US); Christina Freeman, Ladera Ranch, CA (US); Sung Do, Upland, CA (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 10/309,576

(22) Filed: Dec. 3, 2002

(65) Prior Publication Data

US 2004/0069841 A1 Apr. 15, 2004

Related U.S. Application Data

(60) Provisional application No. 60/418,014, filed on Oct. 10, 2002.

(51) Int. Cl.[7] ..... B65D 27/00

(52) U.S. Cl. ..... 229/67.1; 229/67.4

(58) Field of Search ..... 229/84, 68.1, 67.4, 229/92.5, 92.7, 621, 92.8, 71, 76, 77, 79, 87; 281/4, 31, 38; 24/67.11, 67 R; 402/79

(56) References Cited

U.S. PATENT DOCUMENTS

| | | | | | |
|---|---|---|---|---|---|
| 284,272 | A | * | 9/1883 | Brown | 229/67.1 |
| 526,799 | A | * | 10/1894 | Barnard | 229/75 |
| 753,333 | A | * | 3/1904 | Vanderlip | 229/75 |
| 2,017,637 | A | * | 10/1935 | Smith | 229/92.5 |
| 2,780,262 | A | * | 2/1957 | Lennartz | 150/149 |
| 4,795,287 | A | * | 1/1989 | Friedman | 402/79 |
| D308,887 | S | * | 6/1990 | Wyant | D19/26 |
| 4,997,089 | A | * | 3/1991 | Ozeki | 206/455 |
| 5,009,361 | A | * | 4/1991 | Chariton et al. | 229/67.1 |
| 5,125,561 | A | * | 6/1992 | Idstein | 229/400 |
| 5,335,027 | A | * | 8/1994 | Lin et al. | 353/120 |
| 5,806,894 | A | * | 9/1998 | Dottel | 281/38 |

FOREIGN PATENT DOCUMENTS

| | | | | |
|---|---|---|---|---|
| FR | 1125996 | * | 11/1956 | 383/87 |

* cited by examiner

*Primary Examiner*—Jes F. Pascua
(74) *Attorney, Agent, or Firm*—Fulwider Patton Lee & Utecht, LLP

(57) ABSTRACT

A sleeve for holding papers or other material may be provided with an outer corner tab. The sleeve may be formed of a single die-cut sheet of plastic or other material, or from two or more sheets that are attached together. A first sheet may include score lines along two adjacent edges that enable an extended portion of the first sheet to be folded over a second sheet. The second sheet may include score lines that enable an outer corner tab to be formed thereon. The corner tab enables a portion of the papers or other material stored in the sleeve to be inserted into an insert space of the tab. The tab may then be used to retain papers in a secure manner, such that they will not fall out of the sleeve should the sleeve or folder be inverted.

19 Claims, 5 Drawing Sheets

FIG. 2
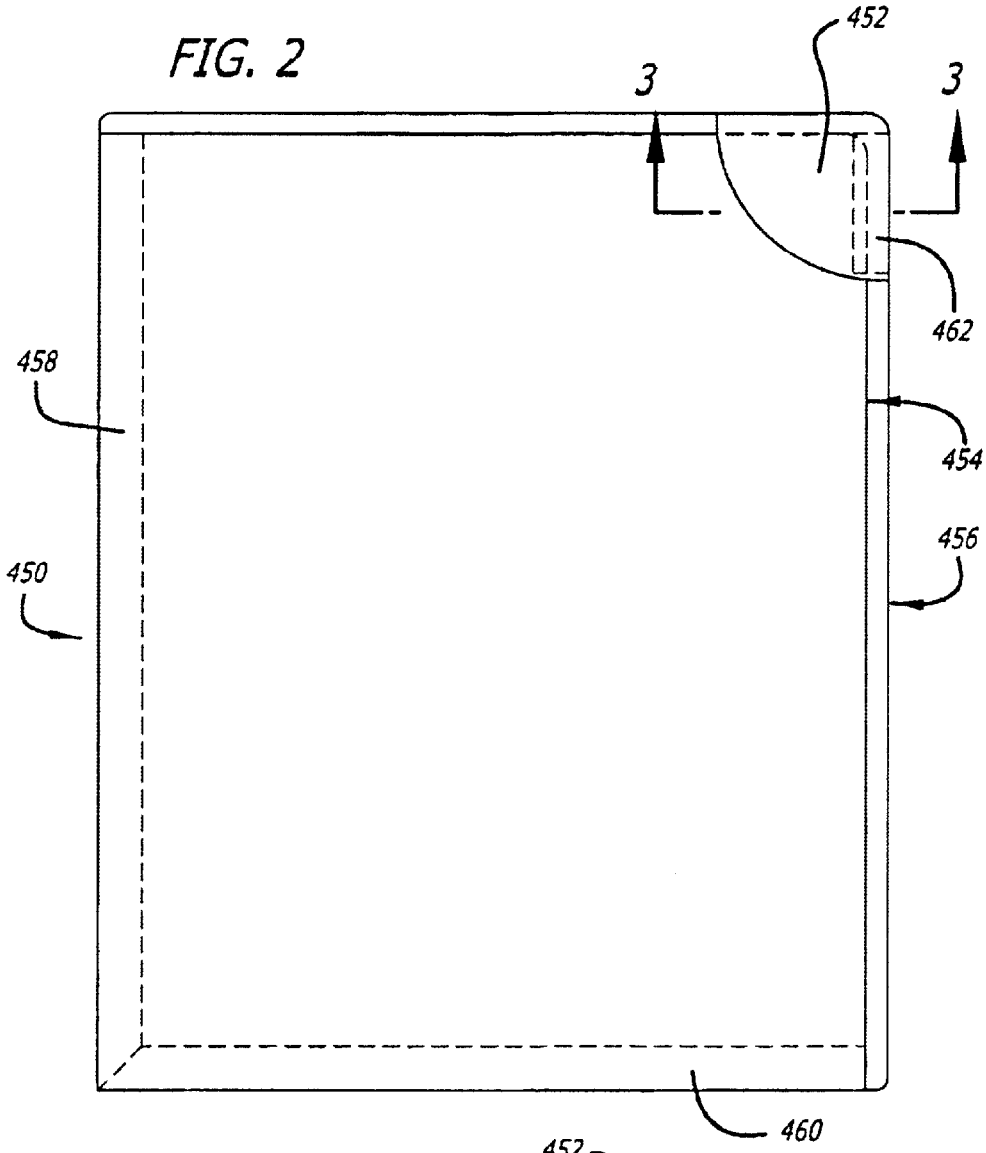
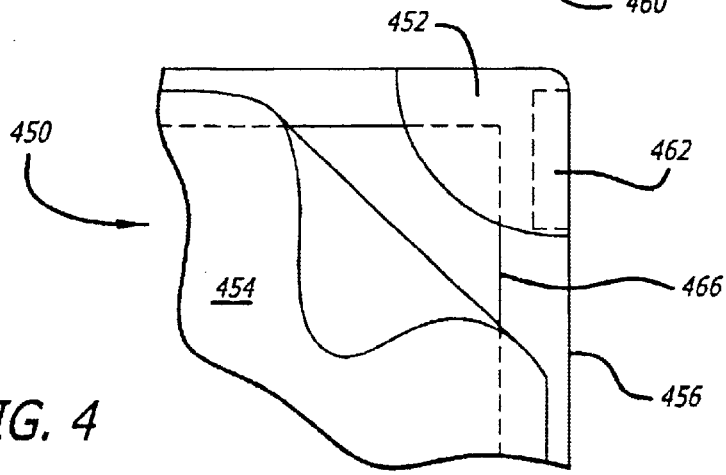
FIG. 4

SLEEVE WITH CORNER TABS

CROSS REFERENCE TO A RELATED APPLICATION

This application is a claims priority from provisional application Ser. No. 60/418,014, filed Oct. 10, 2002 and entitled "SLEEVE WITH CORNER TABS", the disclosure of which is hereby incorporated herein by reference thereto.

FIELD OF THE INVENTION

The invention relates to a document holder for receiving at least one sheet of paper, and more particularly, to a sleeve having a corner tab that receives and retains at least a corner portion of the paper inserted within the sleeve.

BACKGROUND OF THE INVENTION

Document sleeves are used by students, professionals and others to store and present loose leaf papers, hand-outs, pamphlets, and other items. Such sleeves typically have a thin plastic front cover and a back cover that are sealed along two adjacent sides. Documents may be retained in a space in between the front and back covers. Two adjacent sides of the sleeve remain open, so that documents may be inserted and removed from the sleeve.

Document sleeves are often carried in back packs, brief cases, and the like. However, when the front cover is free, papers in the document holder may fall out or become disorganized when the document holder is inverted. An existing approach to securing the sleeve closed is to provide a flap along one open side of the sleeve, under which the front cover may be tucked. However, this approach leaves much to be desired. Even when the front cover is tucked underneath the flap, one edge of the sleeve remains open, and documents retained in the sleeve may slide out. It can also be cumbersome to tuck the front cover underneath the flap.

SUMMARY OF THE INVENTION

According to one embodiment of the invention, a document sleeve has a front cover and a back cover. The front and back covers are interconnected along the two adjacent edges opposite the corner tab. The corner tab provides an insert space for an upper corner of the front cover. It is to be understood that "interconnected" front and back covers may relate to two separate covers that are secured together or, alternatively, to two covers formed from a single sheet and folded along a fold line.

In one embodiment, the front cover and back cover comprise separate sheets of material attached together along the two adjacent edges. In another embodiment, the front and back covers and the corner tab are formed from a single sheet of material.

One embodiment relates to a high-capacity sleeve. The sleeve has a corner tab comprising a corner tab top surface, two corner tab side walls and a corner tab bottom surface. The insert space is defined by the corner tab top and bottom surfaces and the corner tab side walls. The sleeve may be defined by a document sleeve top surface, two adjacent document sleeve side walls and a document sleeve bottom surface.

In one embodiment, the corner tab is initially separate from the front cover and back cover, and is then attached to the back cover.

Various other aspects of the invention will become apparent from a review of the Specification, Drawings and claims.

BRIEF DESCRIPTION OF THE DRAWINGS

FIG. 2 is a top view of a sleeve having a corner tab according to one embodiment of the invention.

FIG. 4 illustrates a sheet of paper inserted into a corner tab of a sleeve according to one embodiment of the invention.

DETAILED DESCRIPTION OF THE PREFERRED EMBODIMENTS

The present application relates to a sleeve having a corner tab, into which an upper corner of the front cover may be inserted and secured. In a preferred embodiment, the corner tab secures a corner of the front cover and sheets that are inserted into the sleeve from two sides. The sheets are thereby securely held within the sleeve.

The corner tab is convenient to close, and securely fastens the front cover. A high capacity version of the corner flap provides space for a stack of papers or other sheets inserted into the sleeve.

Figure 1:
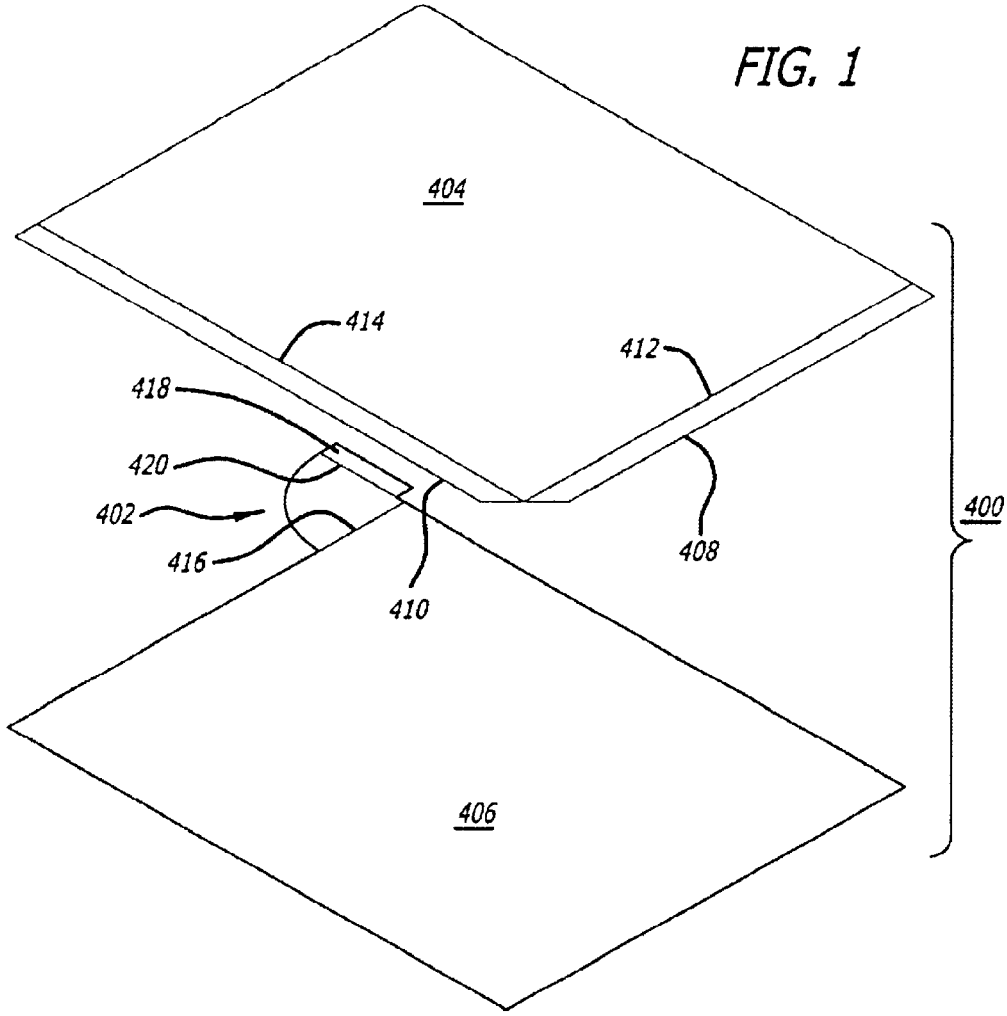
FIG. 1 is an exploded view of a sleeve having an outer corner tab according to one embodiment of the invention.

FIG. 1 illustrates a sleeve 400 having an outer corner tab 402. The sleeve 400 may be formed by securing a front cover sheet 404 to a back cover sheet 406. The front cover sheet 404 may include foldable extended portions 408, 410 that are provided on two adjacent sides of the front cover sheet 404. By having the extended portions 408, 410 of the front cover sheet be provided along adjacent sides, this enables at least one sheet of paper to be inserted into the sleeve 400 along at least one of the other two sides and retained in the sleeve 400. The outer corner tab 402 may be used to retain at least a portion of one corner of the front cover sheet 404 and a paper inserted in the sleeve such that the paper does not fall out in the event that the sleeve is inverted. The extended portions 408, 410 may be folded along score lines 412, 414 and, for example, adhered to an exterior portion of the back cover sheet 406.

The outer corner tab 402 may be folded along a score line 406 provided along a top outer corner of the back cover sheet 406 such that the outer corner tab is folded on top of an exterior portion of the front cover sheet 404. An extended portion 418 may then be folded along a score line 420 after the outer corner tab 402 has been folded along score line 416. The extended portion 418 may be secured to an exterior side of the back cover sheet 406 using any known securing mechanism. The outer corner tab 402 is preferably provided at a corner location of the back cover sheet 406 that is caddy-corner to a corner that includes both extended portions 408, 410 of the front cover sheet 404.

According to another embodiment of the invention, the corner tab 402 may be formed from a separate piece of material. The corner tab 402 may include a separate piece of material that is glued, welded, riveted or otherwise attached to the front cover sheet 404 or back cover sheet 406. The corner tab 402 may include score lines that enable the corner tab 402 to be folded.

FIG. 2 illustrates a top view old sleeve 450 having an outer corner tab 452 according one embodiment of the invention. As FIG. 2 shows, the outer corner tab 452 of this embodiment is a rounded corner tab having a rounded edge, with the rounded edge extending outwardly from the corner tab, as illustrated. The sleeve 450 may include a top piece 454 and a backing piece 456. The top piece 454 may have an area that is less than an area of the backing piece 456. The top piece 454 may include extended portions 458, 460 along two (2) adjacent sides of the top piece 454. The extended portions 458, 460 may be folded along a score line and adhered to an exterior portion of the backing piece 456. This enables at least one sheet of paper or other material to be inserted into the sleeve 450.

The outer corner tab 452 may be formed by folding an extended top portion of the backing piece 456 along a score line provided in the backing piece 456. The backing piece 456 may be positioned at a location that is caddy-corner to a corner of the top piece 454 having adjacent extended portions 458, 460. The outer corner tab 452 may also include an extended portion 462 that may be folded along a score line and adhered to an exterior of the backing piece 456. The outer corner tab 452 may then be used to receive and retain a corner portion of at least one sheet of paper inserted into the sleeve 450 and/or a corner of the top piece 454.

Figure 3:
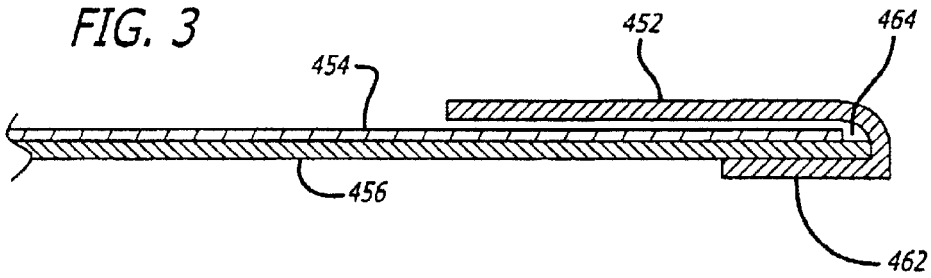
FIG. 3 is a cross-sectional view of a corner tab of a sleeve according to one embodiment of the invention.

FIG. 3 is a cross-sectional view of the outer corner tab 452 shown in FIG. 13. The backing piece 456 may include an extended portion 452 that may be folded along a score line onto an interior of backing piece 456. The backing piece 456 may also include an extended portion 462 that may be folded along an adjacent side of the outer corner tab 452. The extended portion 462 may be secured to an exterior side of the backing piece 456 by, for example, glue, welds, rivets or other securing mechanism. The outer corner tab 452 and backing piece 456 may form an insert space 464 into which at least a corner portion of the top piece 454 and/or at least one sheet of paper or other material received in the sleeve may be inserted.

FIG. 4 illustrates a corner portion of a sleeve 450 having an outer corner tab 452 into which a corner of a sheet of paper 466 or other material is inserted. FIG. 4 also illustrates that a corner of a top piece 454 has been pulled-back. The sleeve 450 may include a back portion 456 having an extended portion that may be used to form outer corner tab 452. The back portion 452 may also include an extended portion 462 that may be used to secure the outer corner tab 452 to an exterior side of the back piece 456. The outer corner tab 452 preferably provides an insert space between the outer corner tab 452 and backing piece 456 for receiving at least one sheet of paper 466 that has been inserted into the sleeve 450. A corner of the top piece 454 has been pulled away to show a corner of the piece of paper 466 inserted beneath the outer corner tab 452. Alternatively, the pulled-back corner of the top piece 454 may also be inserted beneath the outer corner tab 452.

Figure 5:
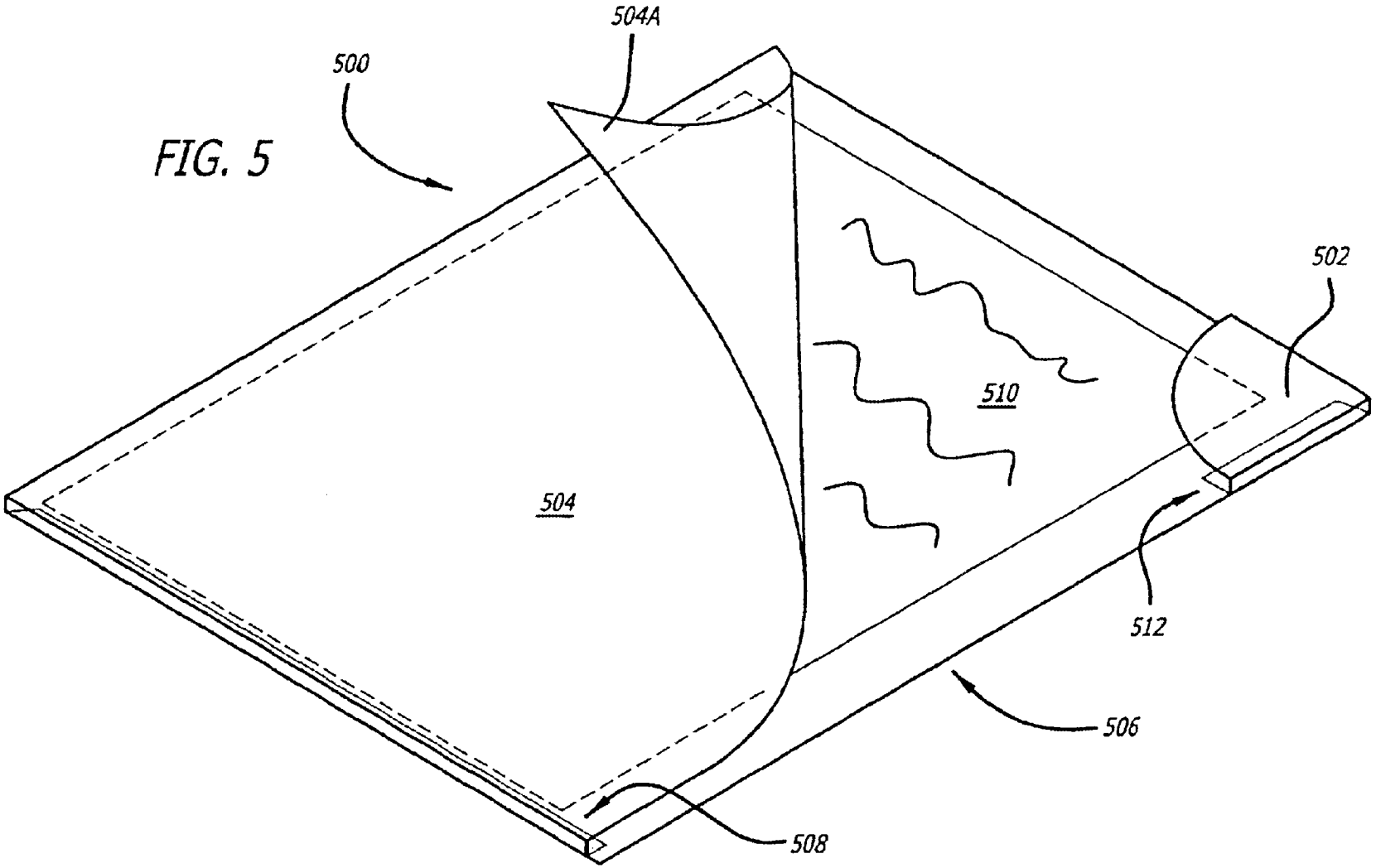
FIG. 5 illustrates a sheet of paper inserted into a corner tab of a sleeve according to one embodiment of the invention.

FIG. 5 illustrates a sleeve 500 having a corner tab 502 according to one embodiment of the invention. The sleeve 500 includes a front piece 504 and a back piece 506. FIG. 16 also illustrates a pulled-back portion 504A of the top piece 504. The sleeve 500 is preferably made from a single sheet of die cut plastic. The sheet may be provided with a plurality of score lines that may be used to form the sleeve 500. The front piece 504 may be attached to the bottom piece along two (2) adjacent sides. The remaining two (2) adjacent sides may be used to enable at least one sheet of paper 510 to be inserted between the front piece 504 and back piece 506. The front piece and the back piece define a central document retention space, in which the paper 510 is retained. A bottom portion of the front piece 504 may include an extended portion 508 that may be folded over and secured to an exterior portion of the back piece 506 to seal the sleeve. The extended portion 508 may be secured using any known securing mechanism such as glue, weld, rivets, etc.

The corner tab 502 may be provided at a corner of the two (2) sides of the back piece that are not attached to the front piece 504. The corner tab 502 may be made from, for example, a portion of back piece 506 that extends at least slightly beyond a top part of the back piece 506. The corner tab 502 may be in a shape of, for example, a quarter circle. Another extended portion 512 may be provided along a side of the corner tab 502 that is opposite to the side of the back piece 506 that is not attached to the front piece 504. The corner tab 502 and extended portion may be indicated by score lines provided at the top part of the back piece 506 and along the extended portion 512.

The corner tab 502 may be folded along the score line along the top part of the back piece 506 and then folded along the score line along the extended portion 512. The extended portion 512 may then be secured to an exterior of the back piece 506 in any known manner. This creates an insert space between the corner tab 502 and back piece 506 that may be used to receive and retain a corner portion of at least one sheet of paper 510 or other material. The corner tab 502 serves to more securely retain the sheet of paper 510 in the sleeve 500. The sheet of paper 510 is retained more securely because, in addition to being maintained by two (2) opposite sides of the sleeve 500, at least a corner portion of the sheet of paper 512 is secured by the corner tab 502. This assists in maintaining the sheet of paper 512 within the sleeve should the sleeve 500 be inverted.

As an alternative, the relative positions of the score line and the extended portion may be switched, such that the corner portion is folded along the side, with the extended portion being on top.

Figure 6:
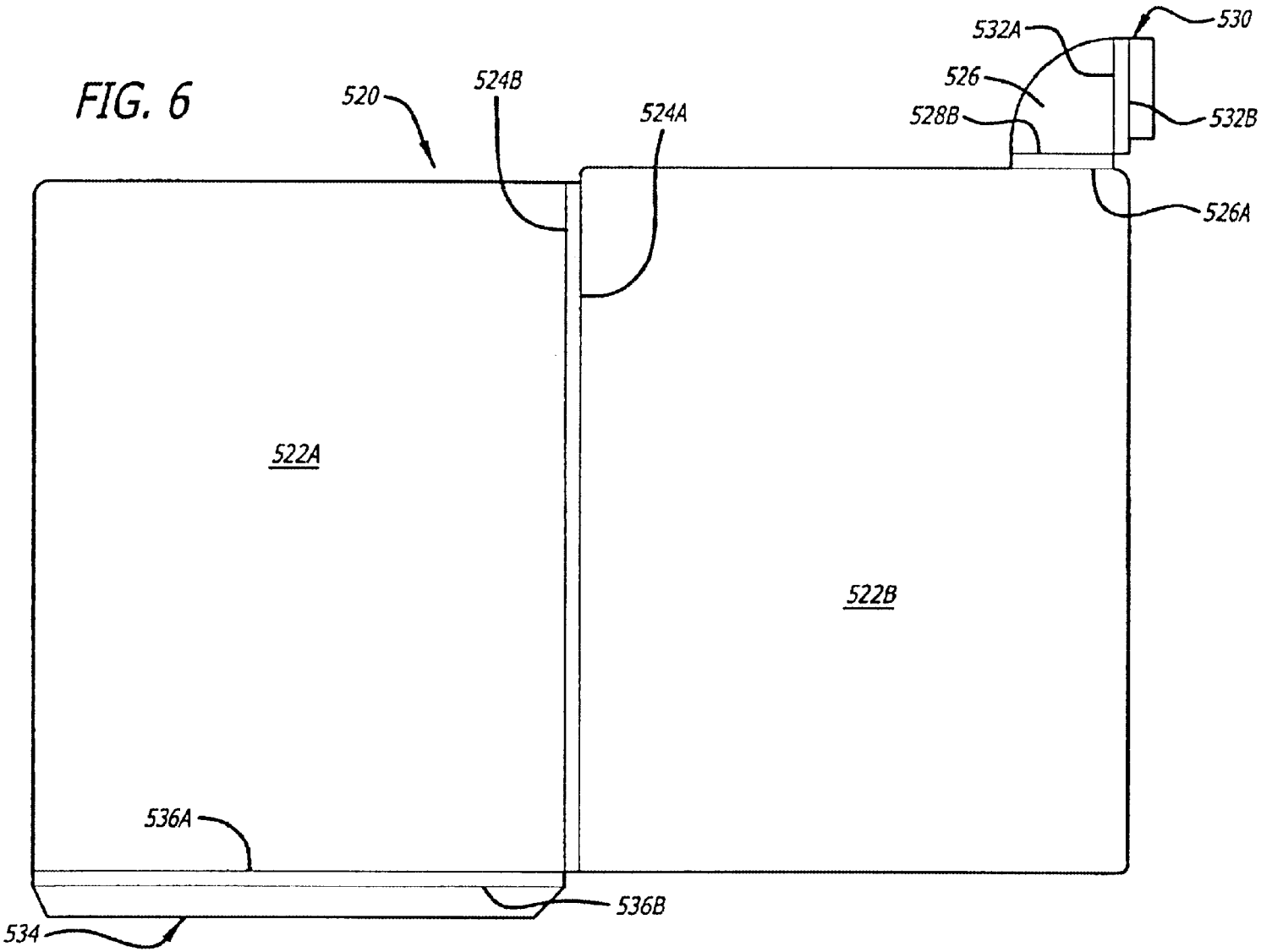
FIG. 6 is a top view of a die-cut sheet of plastic that may be used to form a sleeve having a corner tab according to one embodiment of the invention.

FIG. 6 illustrates a top view of a sheet 520 of, for example, plastic, that may be used to form a document holder such as a sleeve. The sheet 520 may include a front piece 522A and a back piece 522B. The front piece 522A and back piece 522B may be formed by providing the sheet 520 with score lines 524A and 524B. The score lines 524A, 524B may be used to fold the top piece 522A on top of an interior portion of the back piece 522B. The score lines 524A, 524B may be provided such that when the top piece 522A is folded on top of the back piece 524B, a space is created between the top piece 522A and back piece 522B. The space created may vary depending on a distance between the score lines 524A, 524B.

A corner tab 526 may be provided with the back piece 522B as an extended portion of the back piece 522B. The corner tab 526 may be indicated by a score line 528A along a top part of the back piece 522B. The corner tab 526 may also include score lines 528B, 528C that may be used to create an insert space between the back piece 522B and corner tab 526. The corner tab 526 may also include an extended portion 530 that may also be used to create the insert space as well as secure the corner tab 526 to the back piece 522B.

The corner tab 526 may be folded on top of an interior portion of the back piece 522B along the score lines 528A, 528B. The extended portion 530 may then be folded along the score lines 532A, 532B. A distance between the score lines 528A, 528B, 532A, 532B indicate a size of the insert space between the back piece 522B and corner tab 526. The extended portion 530 may then be secured to an exterior portion of the back piece 522B using any known securing mechanism.

According to another embodiment of the invention, the corner tab 526 may be formed from a separate piece of material. The corner tab 526 may include a separate piece of material that is glued, welded, riveted or otherwise attached to the top piece 522A and back piece 522B. The corner tab 526 may include score lines that enable the corner tab 526 to be easily folded, an interior portion of the top piece 522A and back piece 522B and create an insert space between the corner tab 526 and the back piece 522B.

The top piece 522A may include an extended portion 534. The extended portion 534 may be indicated by score lines 536A, 536B. A distance between the score lines 536A, 536B indicate a size of an insert space between the front piece 522A and back piece 522B. The extended portion 534 may be folded along the score lines 536A, 536B such that the extended portion is folded around and secured to the back piece 522B. Therefore, the front piece 522A and back piece 522B are attached along two (2) sides thereof. This enables at least one sheet of paper to be inserted between the front piece 522A and back piece 522B. The corner tab 526 may be used to retain an upper corner portion of the sheet of paper such that the sheet may not fall out when the sleeve is inverted.

Figure 7:
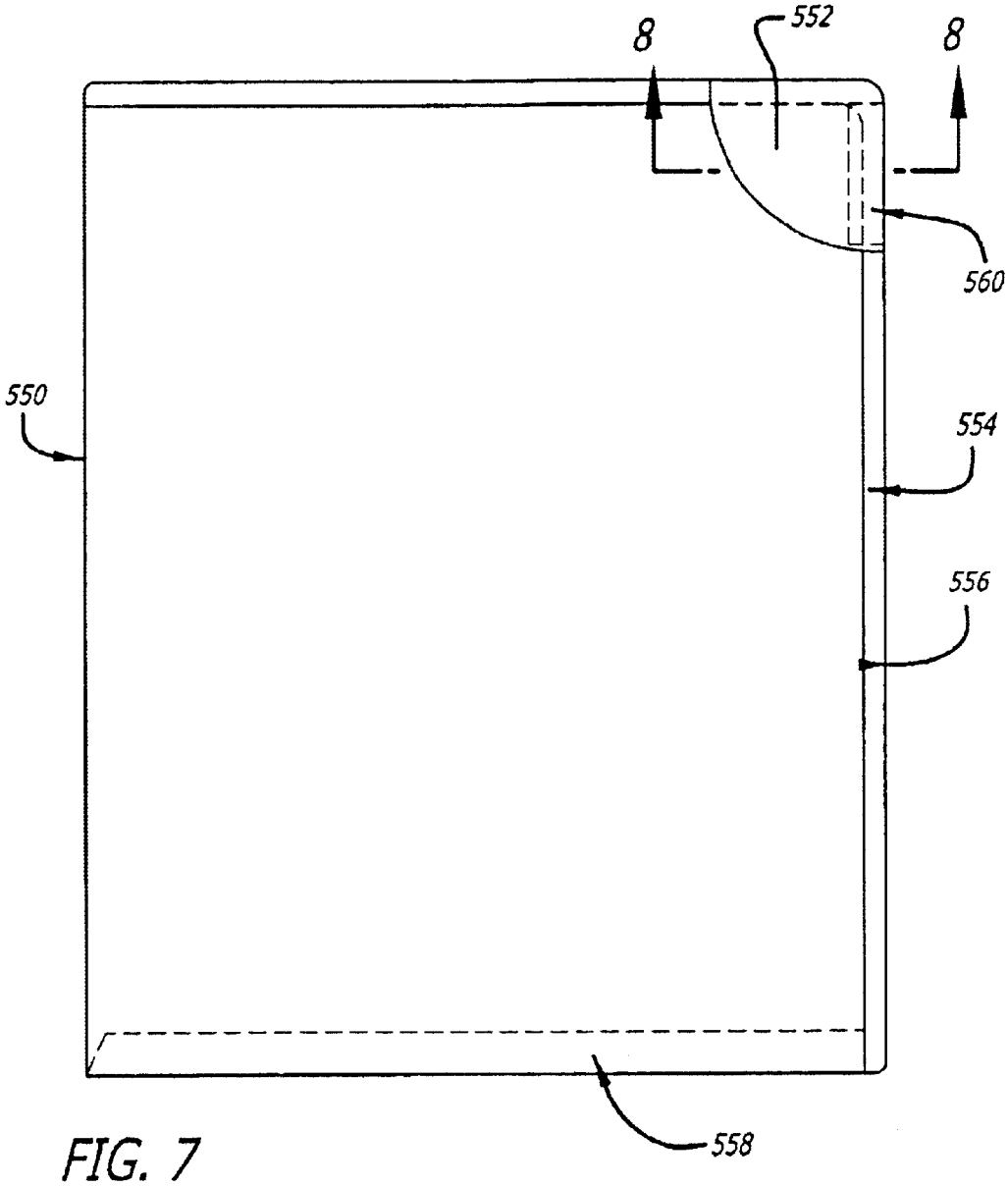
FIG. 7 is a top view of a sleeve having a corner tab according to one embodiment of the invention.

FIG. 7 illustrates a top view of a sleeve 550 having an outer corner tab 552 according to one embodiment of the invention. The sleeve 550 may be made of a single sheet of plastic or other material provided with a plurality of score lines that may be used to form the sleeve 550. The sleeve 550 may include a top piece 554 and a back piece 556. The top piece 554 may be folded on top of the back piece 556 along at least one score line dividing the top piece 554 and back piece 556. The top piece 554 may be secured to the back piece 556 by folding an extended portion 558 of the top piece along at least one score line and securing the extended portion 558 to an exterior portion of the back piece 558 by gluing, welding, riveting or other known secure method.

The outer corner tab 552 may be an extended portion of the back piece 556. The outer corner tab may be formed by folding the outer corner tab 552 along at least one score line on top of an interior portion of the back piece 556. This facilitates inserting at least one sheet of paper and/or the top piece 554 between the outer corner tab 552 and the back piece 556. The outer corner tab 552 may also include an extended portion 560 that may be folded along a score line and around the back piece 556. The extended portion 556 may be secured to an exterior of the back piece 556 using any known securing mechanism.

Figure 8:
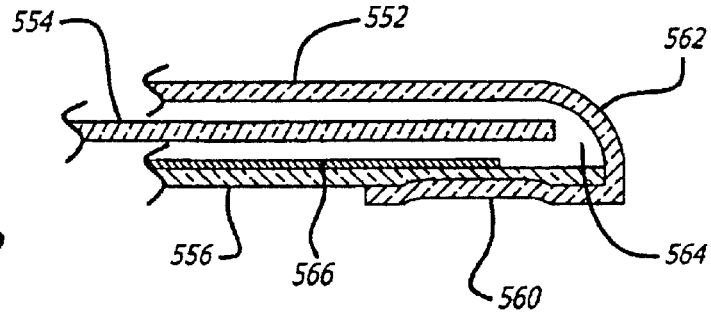
FIG. 8 is a cross-sectional view of a corner tab of a sleeve according to one embodiment of the invention.

FIG. 8 is a cross-sectional view of the outer corner tab 552 of the sleeve 550 illustrated in FIG. 7 according to one embodiment of the invention. The back piece 556 may be adhered or otherwise secured to the extended portion 560 of the outer corner tab 552. The insert space 564 may be used to receive and retain the front piece 554 and/or at least one sheet of paper 566 inserted into the sleeve.

Alternatively, in a high-capacity embodiment, the outer corner tab is folded along at least two (2) score lines to create a high-capacity insert space between the outer corner tab 552 and back piece 556. The outer corner tab 552 may include a side wall separator in between the two (2) score lines to create a wide insert space between the outer corner tab and back piece 556. The separator may be of varying heights depending on a distance between score lines used to create the separator.

Concerning materials, the sleeve may be constructed with any of a variety of sheet materials. In one embodiment, the sleeve is made from light cardstock or paper. In another embodiment, the sleeve is made of a polymer, or any plastic material known in the art. The front cover will typically be transparent, although it may alternatively be translucent or opaque. In embodiments in which two separate sheets are used to form the front and rear covers, respectively, the sheets may be different materials.

While the specification describes particular embodiments of the present invention, those of ordinary skill can devise variations of the present invention without departing from the inventive concept.

We claim:

1. A document sleeve having a corner tab comprising:

a front cover having a free upper corner;

a back cover;

a rounded corner tab having a rounded portion on an upper corner of the back cover;

said front cover and said back cover being interconnected along the two adjacent edges opposite said corner tab; said corner tab providing an insert space for said free corner of said front cover to secure said free corner of said front cover within said corner tab, with said rounded portion of maid corner tab being adapted to over said free corner when said free corner is within said corner tab, wherein the front cover and back cover comprise separate sheets of material attached together along said two adjacent edges, said back cover comprising a relatively rigid sheet material and said front cover comprising a relatively flexible sheet material as compared to said back cover.

2. A document sleeve aa described in claim 1, wherein one of said front cover and said back cover comprise foldable extended portions on two adjacent sides of the sheet for securing the front cover to the back cover.

3. A document sleeve having a corner tab comprising:

a front cover having a free upper corner;

a back cover;

a rounded corner tab on a upper corner of the back cover;

said front cover and said back cover being interconnected along the two adjacent edges opposite said corner tab; said corner tab providing an insert space for said free corner of said front cover to secure said free corner of said front cover within said corner tab, with said rounded portion of said corner tab being adapted to extend over said free corner when said free corner is within said corner tab, wherein the document sleeve is a high-capacity sleeve, with the corner tab comprising a top surface, two side walls and a bottom surface, said insert space being defined by said top and bottom surfaces and said side walls.

4. A document sleeve as described in claim 3, wherein the document sleeve is a high-capacity sleeve, said sleeve comprising a top surface, two adjacent side walls and a bottom surface.

5. A document sleeve as described in claim 4, wherein the high-capacity sleeve is formed from two separate sheets of material.

6. A document sleeve having a corner tab comprising:

a front cover having a free upper corner;

a back cover;

a corner tab on an upper corner of the back cover;

said front cover and said back cover being interconnected along the two adjacent edges opposite said corner tab;

said corner tab providing an insert space for said upper corner of said front corner;

wherein the corner tab comprises a top corner tab surface and a separator, said insert space being defined by said top corner tab surface and said separator; and said front cover and said back cover being interconnected along said two adjacent edges, each with a respective side wall, said front cover, back cover and side walls defining a document-retaining space.

7. A document sleeve as described in claim 6, wherein said document-retaining space is sufficiently wide to accommodate at least 50 sheets of paper.

8. A document sleeve as described in claim 6, wherein the sleeve is formed from two separate sheets of material joined along two respective edges thereof.

9. A document sleeve as described in claim 8, wherein said two separate sheets are different materials.

10. A document sleeve as described in claim 6, wherein the corner tab is rounded with a rounded portion extending over the upper corner when the upper corner is inserted into the corner tab.

11. A document sleeve as described in claim 6, wherein the corner tab is initially separate from said front cover and back cover, and is then attached to said back cover.

12. A document sleeve as described in claim 11, wherein the corner tab is attached by at least one of heat welding, sonic welding or gluing.

13. A document sleeve having a corner tab comprising:

a front cover having an interior and an exterior;

a back cover having an interior and an exterior;

a corner tab on an upper corner of the interior of the back cover, with a corner tab insert space in between the corner tab and the back cover;

said front cover and said back cover being interconnected along two adjacent sides opposite said corner tab, said front cover having a free upper corner;

a document retention space in between said front cover and said back cover, at least one side adjacent to said corner tab being open to said document retention space;

wherein the corner tab insert space is adapted to receive said free corner of the front cover, and wherein said corner tab having a portion that extends outwardly from said corner tab, said extending portion being adapted to extend over sand free upper corner of said front cover when said free upper corner is inserted into said corner tab, wherein the document sleeve is a high-capacity sleeve, with the corner tab comprising a top surface, two side walls and a bottom surface, said two adjacent side walls creating an insert space between said top and bottom surfaces.

14. A document sleeve as described in claim 13, wherein th high-capacity sleeve is formed from two separate sheets of material.

15. A document sleeve as described in claim 13, wherein said front cover, back cover, and corner tab are unitarily formed from a single sheet of material.

16. A document sleeve as described in claim 13, wherein the corner tab is initially separate from said front cover and back cover, and is then attached to said back cover.

17. A document sleeve as described in claim 16, wherein the corner tab is attached by heat welding, sonic welding or gluing.

18. A document sleeve comprising:

a front cover having a free corner;

a back cover;

said front cover and said back cover being attached along two adjacent edges to form a sleeve;

means for securing said free corner of said front cover to said back cover, wherein said means for securing said free corner of said front cover to said back cover can accommodate at least 50 sheets of paper.

19. A document sleeve having a corner tab comprising:

a front cover having a free upper corner;

a back cover;

a corner tab on an upper corner of the back cover;

said front cover and said back cover being interconnected along the two adjacent edges opposite said corner tab;

said corner tab providing an insert space for said upper corner of said front cover;

wherein the corner tab comprises a top corner tab surface and a seperator; said insert space being defined by said top corner tab surface and said seperator; and said front cover and said back cover being interconnected along said two adjacent edges, each with a respective side wall, said front cover, back cover and side walls defining a document-retaining space, wherein the sleeve is formed from two seperate sheets of material joined along two respective edges thereof, one sheet of material being the front cover, which is relatively flexible, the other sheet being the bak cover, which is relatively stiff as compared to the front cover, said corner tab also beiing relatively stiff as compared to said front cover.

* * * * *

UNITED STATES PATENT AND TRADEMARK OFFICE

CERTIFICATE OF CORRECTION

PATENT NO. : 6,913,188 B2
DATED : July 5, 2005
INVENTOR(S) : Wong et al.

It is certified that error appears in the above-identified patent and that said Letters Patent is hereby corrected as shown below:

Column 6,
Line 29, delete “maid” and insert -- said --.
Line 37, delete “aa” and insert -- as --.

Column 7,
Line 49, delete “sand” and insert -- said --.

Column 8,
Line 46, delete “bak” and insert -- back --.
Line 48, delete “being” and insert -- being --.

Signed and Sealed this

Sixth Day of September, 2005

JON W. DUDAS
*Director of the United States Patent and Trademark Office*